US005413518A

United States Patent [19]

Lin

[11] Patent Number: 5,413,518

[45] Date of Patent: May 9, 1995

[54] PROXIMITY RESPONSIVE TOY

[76] Inventor: Ming-Tuan Lin, 8F, No. 196-10, Chung-Hwa Rd., Yung-Kang Hsiang, Tainan Hsien, Taiwan, Prov. of China

[21] Appl. No.: 182,775

[22] Filed: Jan. 18, 1994

[51] Int. Cl.[6] ..... A63H 30/00

[52] U.S. Cl. ..... 446/454; 446/484; 446/292; 318/478; 273/460

[58] Field of Search ..... 446/454, 456, 484, 290, 446/270, 441, 444, 175, 442, 292; 318/568.16, 445, 466, 478, 489, 558, 567; 340/562, 572, 573; 273/85 G, 86 R, 86 B, 148 B, 460, 454

[56] References Cited

U.S. PATENT DOCUMENTS

| | | | |
|---|---|---|---|
| 3,384,074 | 5/1968 | Rautiola et al. | 446/297 X |
| 3,782,031 | 1/1974 | Byron | 446/442 X |
| 4,272,916 | 6/1981 | Giordano et al. | 446/454 X |
| 5,019,804 | 5/1991 | Fraden | 340/562 |
| 5,081,406 | 1/1992 | Hughes et al. | 318/478 |
| 5,267,886 | 12/1993 | Wood et al. | 446/175 |
| 5,324,225 | 6/1994 | Satoh et al. | 446/175 |

*Primary Examiner*—Jessica J. Harrison
*Attorney, Agent, or Firm*—Willian Brinks Hofer Gilson & Lione

[57] ABSTRACT

A proximity responsive toy includes a motor-driven drive unit for propelling the toy, and a variable frequency oscillator unit including a capacitor plate for sensing approach of a capacitive body and having a frequency output that decreases in response to proximity of the capacitive body from the toy. A programmable frequency divider receives and divides the frequency output by a predetermined factor. A programmable microcomputer control unit includes a counter unit which generates a count output corresponding to a divided frequency output from the divider, a programmable timer unit which controls a register unit to store the count output therein a predetermined time period after activation of the power supply unit, a reset unit which resets the counter unit, the register unit and the timer unit upon activation of the power supply unit, a programmable offset value generating unit for generating a predetermined offset value, an adder for generating an output corresponding to the sum of the count output and the offset value, and a comparator unit controlled by the timer unit to compare the output of the adder and contents of the register unit periodically. The comparator unit activates the drive unit for a predetermined period when the output of the adder is less than the contents of the register unit.

2 Claims, 5 Drawing Sheets

PROXIMITY RESPONSIVE TOY

BACKGROUND OF THE INVENTION

1. Field of the Invention

This invention relates to a proximity responsive toy which is responsive to the approach of a body part.

2. Description of the Related Art

U.S. Pat. No. 4,272,916 by Giordano et al. discloses a toy which is in the form of a pup and which has a motor-driven drive means therein. The drive means is coupled to ground wheels and is activated to drive the ground wheels when a capacitive body approaches to the toy.

The main drawback of the Giordano et al. patent is that the sensitivity of the toy cannot be adjusted in accordance with variations in environmental conditions, such as humidity. This results in faulty operation of the toy.

SUMMARY OF THE INVENTION

Therefore, the main object of the present invention is to provide a proximity responsive toy in which the sensitivity thereof is adjustable.

According to this invention, a proximity responsive toy includes a power supply means for supplying electrical energy, a motor-driven drive means connected to the power supply means for propelling the toy, a variable frequency oscillator means, a programmable frequency divider, and a programmable microcomputer control unit. The variable frequency oscillator means includes a capacitor plate means located on the toy for sensing approach of a capacitive body. The oscillator means has a frequency output which decreases in response to proximity of the capacitive body from the toy. The programmable frequency divider is connected to the oscillator means and divides the frequency output of the oscillator means by a predetermined factor. The programmable microcomputer control unit is connected to the frequency divider and the drive means. The microcomputer control unit includes a counter means, a register means, a reset means, a programmable offset value generating means, an adder means and a comparator means. The counter means generates a count output corresponding to a divided frequency output from the frequency divider. The programmable timer means controls the register means to store the count output of the counter means therein a predetermined time period after activation of the power supply means. The reset means resets the counter means, the register means and the timer means upon activation of the power supply means. The programmable offset value generating means generates a predetermined offset value. The adder means generates an output corresponding to the sum of the count output of the counter means and the offset value from the offset value generating means. The comparator means is controlled by the timer means to compare the output of the adder means and contents of the register means periodically. The comparator means resets the counter means and the timer means when the output of the adder means is at least equal to the contents of the register means. The comparator means activates the drive means for a predetermined period when the output of the adder means is less than the contents of the register means.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
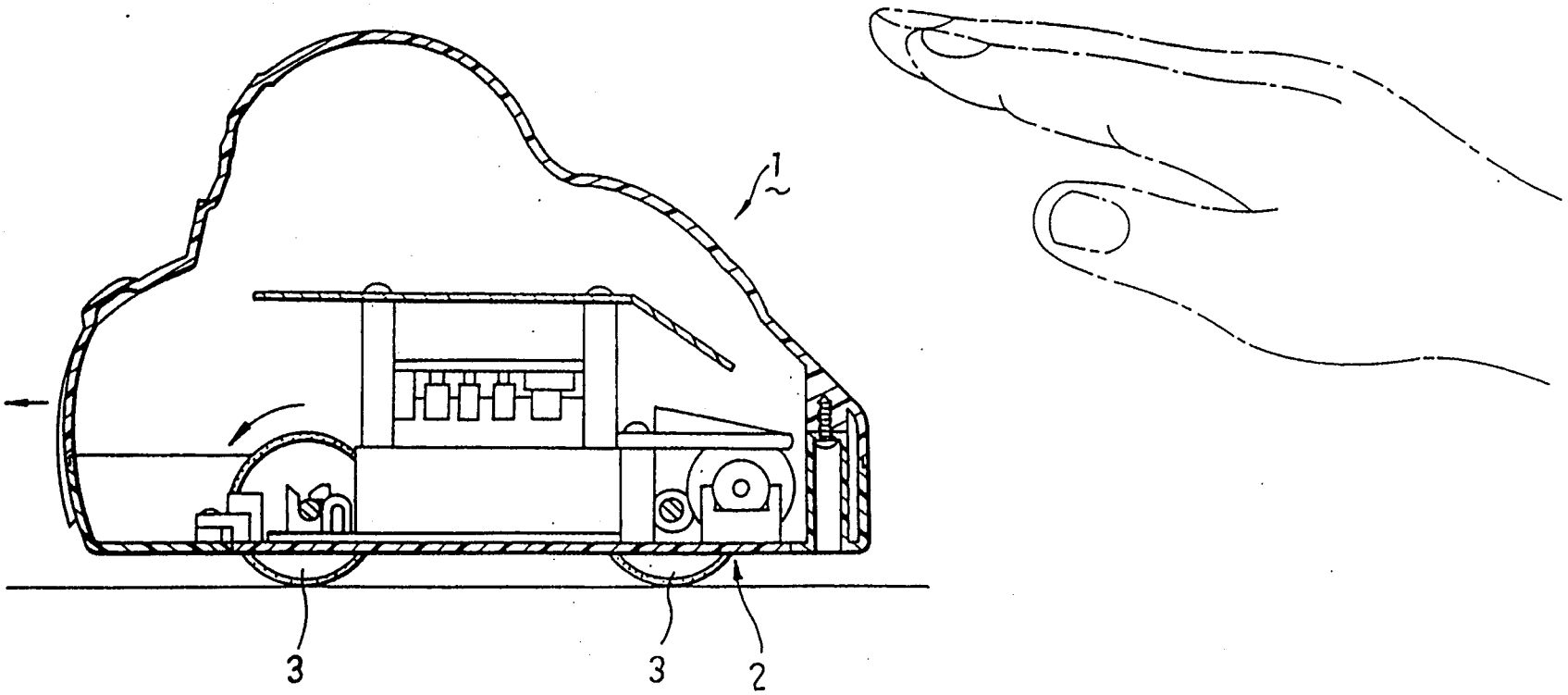
FIG. 1 is a longitudinal sectional view through a representative toy which embodies the present invention.
Figure 2A:
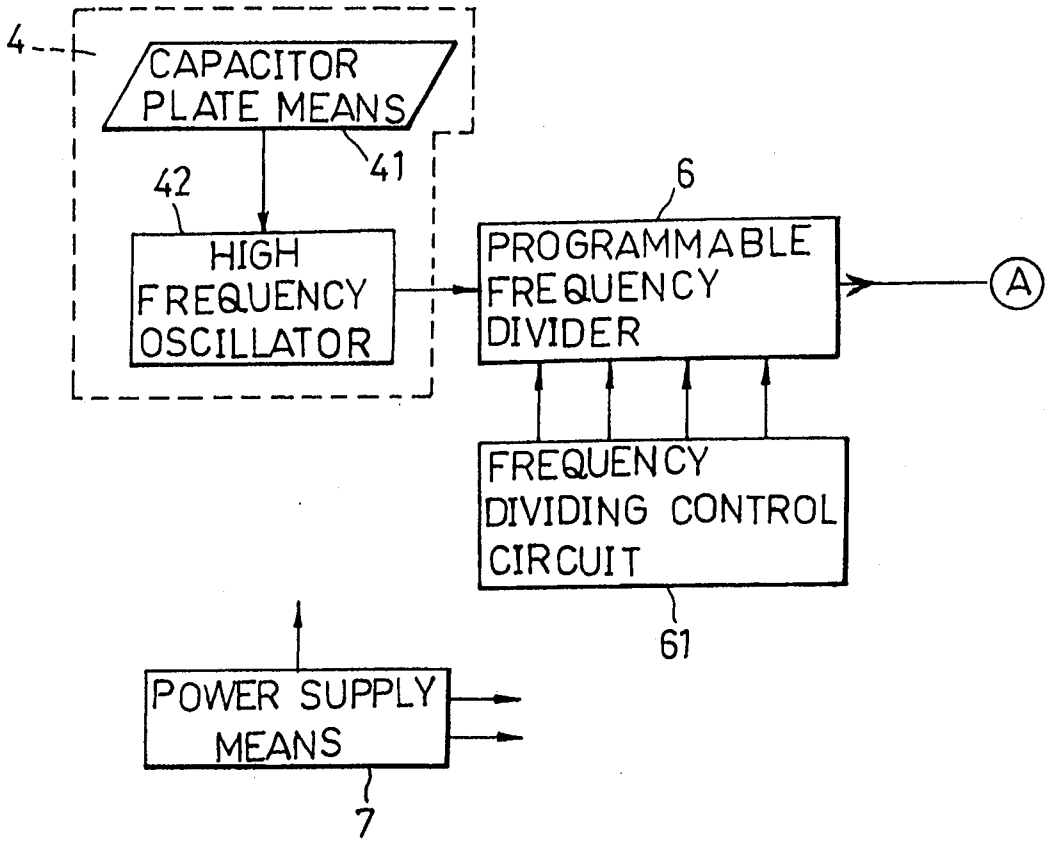
FIGS. 2A and 2B are respectively the first and second portions of a schematic block diagram showing an electrical circuitry employed in the proximity responsive toy according to the present invention.
Figure 2B:
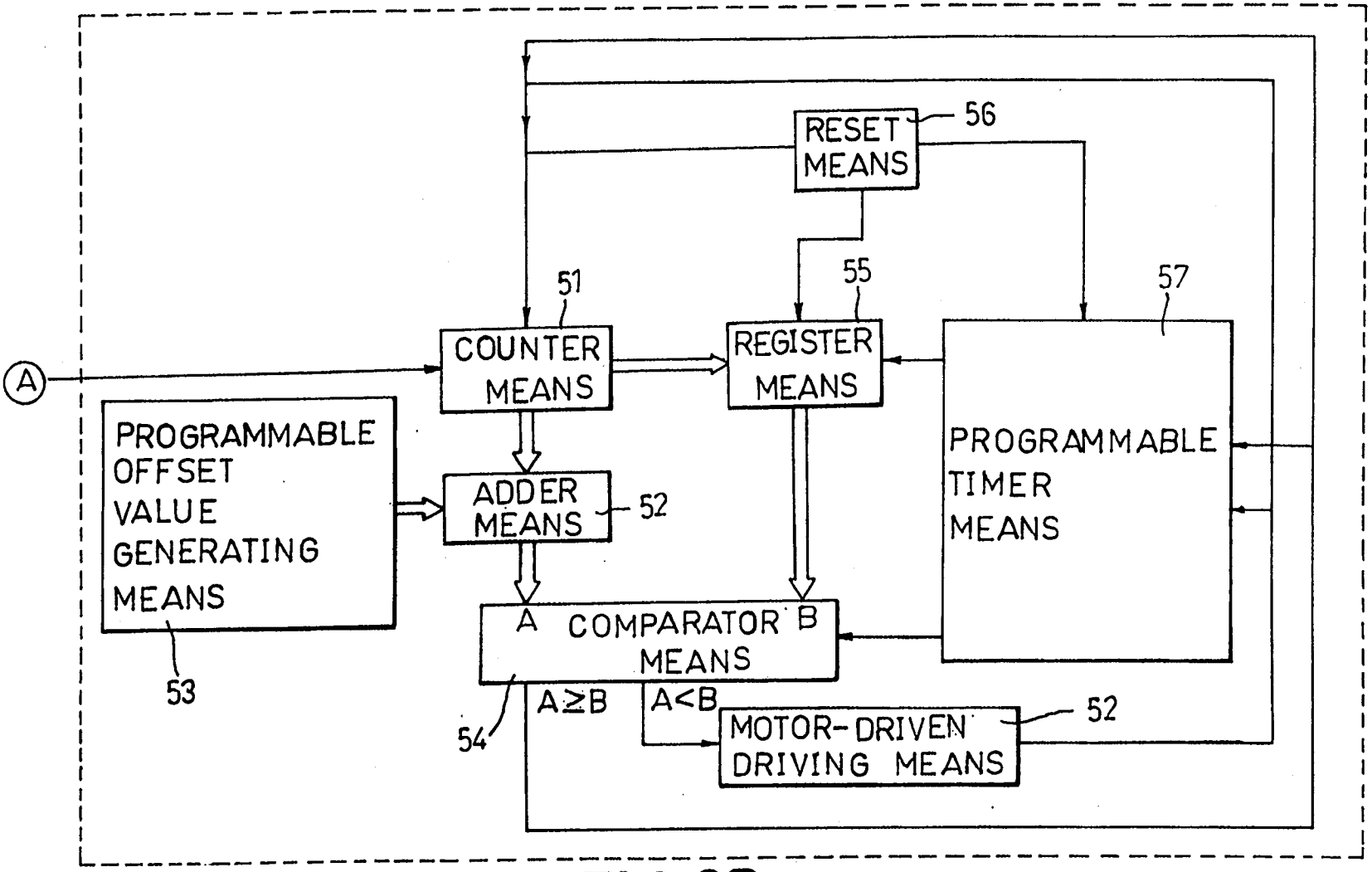
Figure 3A:
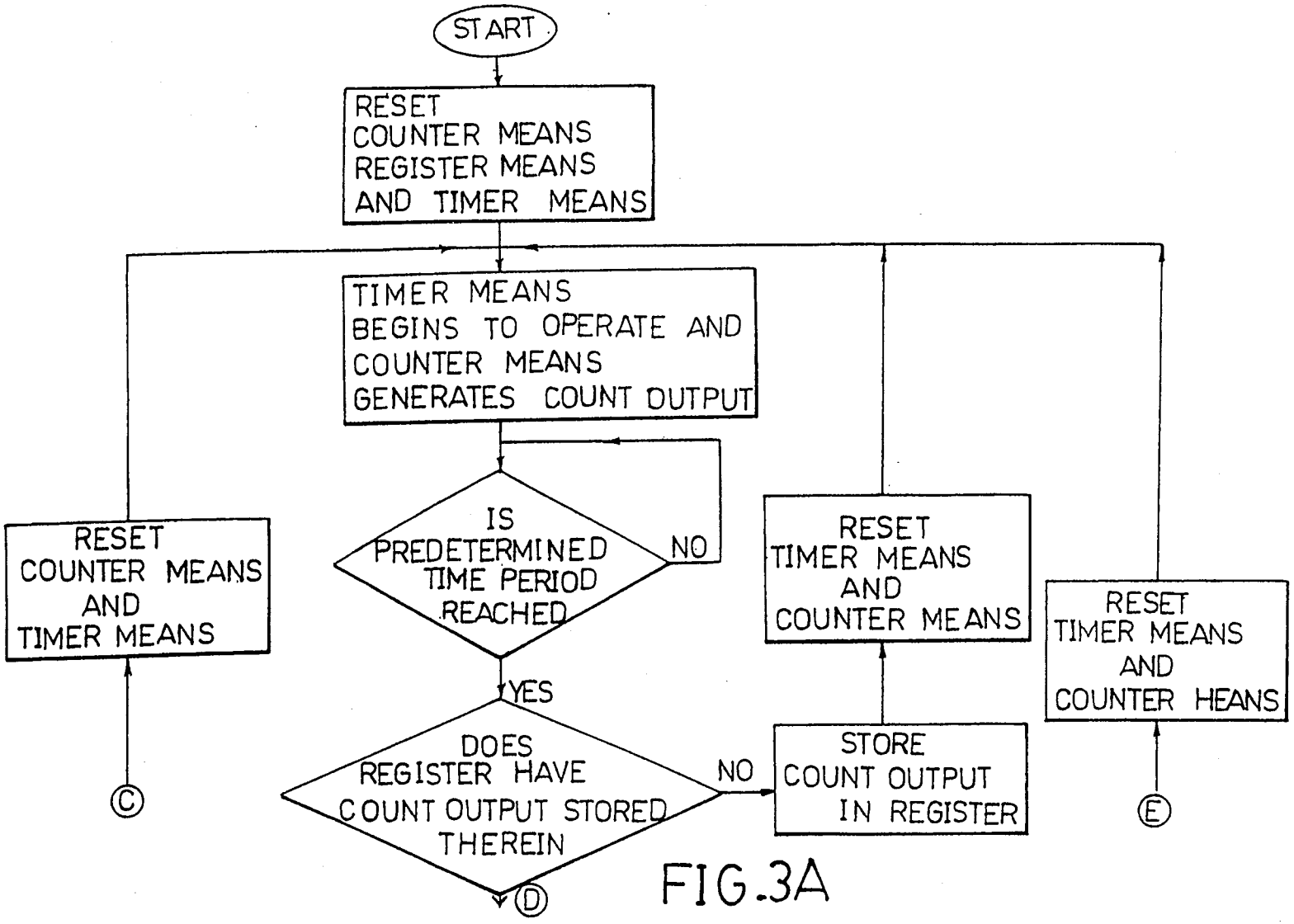
FIGS. 3A and 3B are respectively the upper and lower portions of a flow chart illustrating the operation of a programmable microcomputer control unit employed in the proximity responsive toy according to the present invention.
Figure 3B:
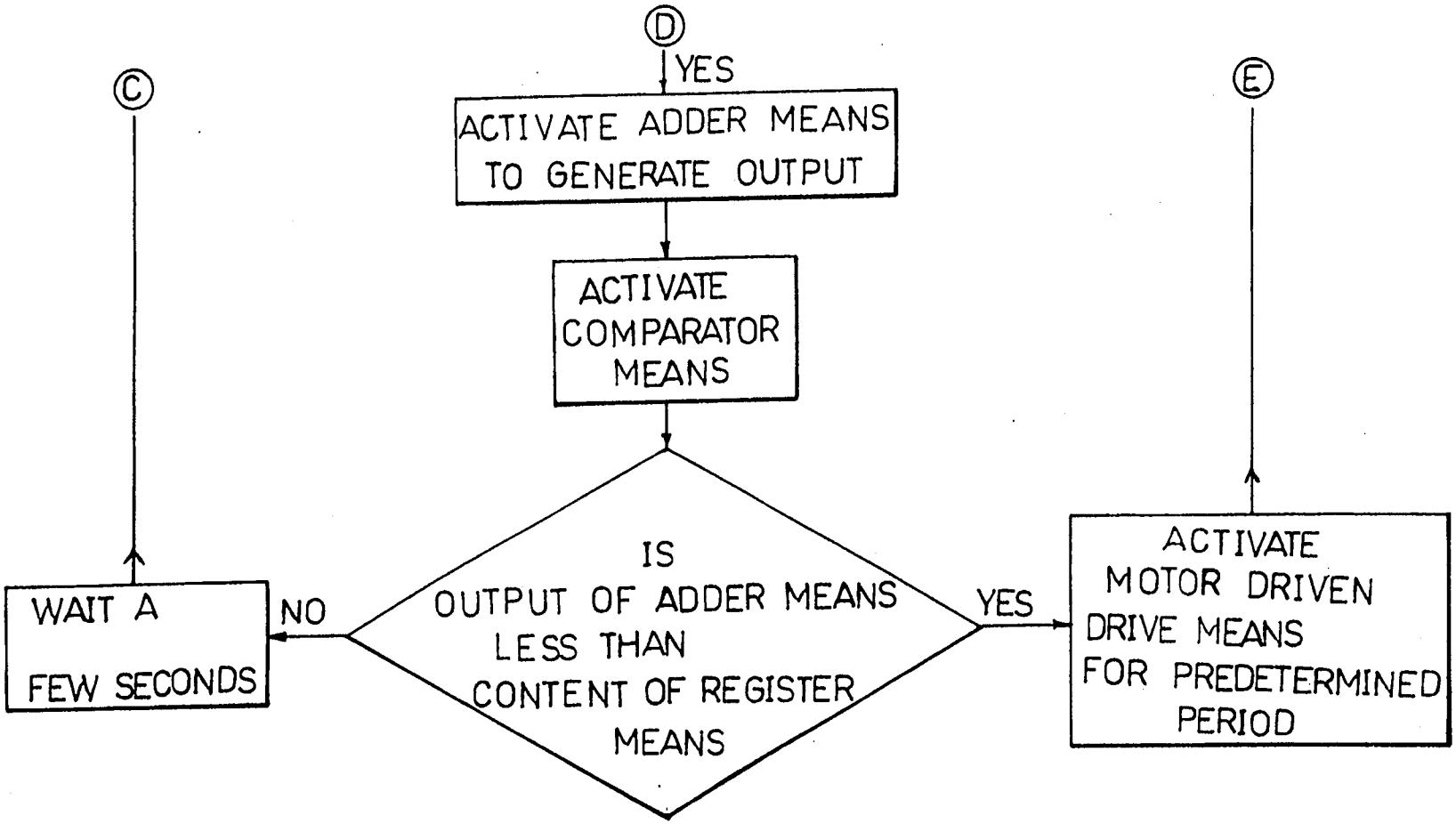

Referring to FIGS. 1, 2A and 2B, a proximity responsive toy according to the present invention includes a hollow body 1, a motor-driven drive means 2, a variable frequency oscillator means 4, a programmable frequency divider 6, a programmable microcomputer control unit 5 and a power supply means 7.

The hollow body 1 is configured to represent a car or the like. The body 1 is supported by ground wheels 3 which are driven by a motor-driven drive means 2 when the latter is activated. The motor-driven drive means 2 is conventional in construction and will not be detailed herein.

The power supply means 7 is adapted to be provided in the body 1 and is adapted to be coupled electrically to the motor-driven drive means 2 for supplying electrical energy thereto. The power supply means 7 is adapted to be activated by operating a conventional switch unit (not shown). The power supply means 7 is also conventional in construction and will not be detailed herein.

The variable frequency oscillator means 4 includes a capacitor plate means 41 located in the body 1 for sensing approach of a capacitive body, such as a human hand, as shown by the phantom lines in FIG. 1. The capacitor plate means 41 is made from stainless steel or aluminum. The oscillator means 4 further includes a high frequency oscillator 42 that is connected to the capacitor plate means 41. The high frequency oscillator 42 has a frequency output which decreases in response to proximity of the capacitive body from the capacitor plate means 41 of the toy.

The programmable frequency divider 6 is connected to the oscillator 42 and receives the frequency output from the latter. The frequency divider 6 divides the frequency output of the oscillator 42 by a predetermined factor. This factor can be varied by operating a frequency dividing control circuit 61 so that the sensitivity of the toy to the approach of a capacitive body can be varied as desired.

The programmable microcomputer control unit 5 is connected to the frequency divider 6 and the drive means 2. The microcomputer control unit 5 includes a counter means 51, a register means 55, a programmable timer means 57, a reset means 56, a programmable offset value generating means 53, an adder means 52, and a comparator means 54.

The counter means 51 receives a divided frequency output from the frequency divider 6 and generates a count output corresponding to the divided frequency output.

The programmable timer means 57 controls the register means 55 to store the count output of the counter means 51 therein a predetermined time period after activation of the power supply means 7, such as 125 ms. This time period can be varied by adjusting the programmable timer means 57.

The reset means 56 resets the counter means 51, the register means 55 and the timer means 57 upon the activation of the power supply means 7.

The programmable offset value generating means 53 generates a predetermined offset value. The sensitivity of the toy to the approach of a capacitive body can also be varied by adjusting the programmable offset value generating means 53 to generate an appropriate offset value.

The adder means 52 generates an output corresponding to the sum of the count output of the counter means 51 and the offset value from the offset value generating means 53.

The comparator means 54 is controlled by the timer means 57 to compare the output of the adder means 52 and the contents of the register means 55 periodically, such as every 125 ms. The comparator means 54 resets the counter means 51 and the timer means 57 when the output of the adder means 52 is greater than or equal to the contents of the register means 55. The comparator means 54 activates the drive means 2 for a predetermined period when the output of the adder means 52 is less than the contents of the register means 55.

Referring now to FIGS. 2A, 2B, 3A and 3B, in operation, when the power supply means 7 is activated by operating the conventional switch unit, the reset means 56 is activated to reset the counter means 51, the register means 55 and the timer means 57. At the same time, the oscillator 42 and the frequency divider 6 are activated. The timer means 57 begins to operate, and the counter means 51 receives a divided frequency output from the frequency divider 6 and generates a corresponding count output. The timer means 57 operates continuously until a predetermined time period, such as 125 ms, is reached. When the predetermined time period is reached, the register means 55 is checked to determine whether it has a count output stored therein. If the register means 55 has no count output stored therein, the timer means 57 controls the register means 55 to store the count output from the counter means 51 therein. The timer means 57 and the counter means 51 are reset and begin a new counting cycle. On the other hand, if the register means 55 has a stored count output therein, the adder means 52 is activated to generate an output corresponding to the sum of the count output of the counter means 51 and the offset value from the offset value generating means 53. The comparator means 54 is then activated to compare the output of the adder means 52 and the contents of the register means 55. If the output of the adder means 52 is greater than or equal to the contents of the register means 55, that is to say, no capacitive body is within a sensing range of the toy, the counter means 51 and the timer means 57 are reset by the comparator means 54 after a few seconds, and begin another counting cycle.

When a capacitive body, such as the human hand shown in FIG. 1, approaches the toy, the frequency output of the oscillator 42 decreases. If the comparator means 54 has detected that the output of the adder means 52 is less than the contents of the register means 55, the comparator means 54 activates the motor-driven drive means 2 for a predetermined period, such as a few seconds. Then, the timer means 57 and the counter means 51 are reset by the comparator means 54, and begin another counting cycle.

Therefore, from the above description, the sensitivity of the toy can be varied by programming the frequency divider 6 or by adjusting the offset value which is generated by the programmable offset value generating means 53. The objective of the present invention is thus attained.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A proximity responsive toy, comprising:

a power supply means for supplying electrical energy;

motor-driven drive means connected to said power supply means for propelling said toy;

variable frequency oscillator means including a capacitor plate means on said toy for sensing approach of a capacitive body, said oscillator means having a frequency output which decreases in response to proximity of the capacitive body from said toy;

a programmable frequency divider connected to said oscillator means, said frequency divider dividing said frequency output of said oscillator means by a predetermined factor; and a programmable microcomputer control unit connected to said frequency divider and said drive means, said microcomputer control unit including: counter means for generating a count output corresponding to a divided frequency output from said frequency divider; register means; programmable timer means for controlling said register means to store said count output of said counter means therein a predetermined time period after activation of said power supply means; reset means for resetting said counter means, said register means and said timer means upon activation of said power supply means; programmable offset value generating means for generating a predetermined offset value; adder means for generating an output corresponding to the sum of said count output of said counter means and said offset value from said offset value generating means; and comparator means controlled by said timer means to compare said output of said adder means and contents of said register means periodically, said comparator means resetting said counter means and said timer means when said output of said adder means is at least equal to the contents of said register means, said comparator means activating said drive means for a predetermined period when said output of said adder means is less than the contents of said register means.

2. A control circuit for controlling a motor-driven drive means of a proximity responsive toy to propel the toy, comprising:

a power supply means connected to said motor-driven drive means for supplying electrical energy;

variable frequency oscillator means including a capacitor plate means on said toy for sensing approach of a capacitive body, said oscillator means having a frequency output which decreases in response to proximity of the capacitive body from said toy;

a programmable frequency divider connected to said oscillator means, said frequency divider dividing said frequency output of said oscillator means by a predetermined factor; and a programmable microcomputer control unit connected to said frequency divider and said drive means, said microcomputer control unit including: counter means for generating a count output corresponding to a divided frequency output from said frequency divider; register means; programmable timer means for controlling said register means to store said count output of said counter means therein a predetermined time period after activation of said power supply means; reset means for resetting said counter means, said register means and said timer means upon activation of said power supply means; programmable offset value generating means for generating a predetermined offset value; adder means for generating an output corresponding to the sum of said count output of said counter means and said offset value from said offset value generating means; and comparator means controlled by said timer means to compare said output of said adder means and contents of said register means periodically, said comparator means resetting said counter means and said timer means when said output of said adder means is at least equal to the contents of said register means, said comparator means activating said drive means for a predetermined period when said output of said adder means is less than the contents of said register means.

* * * * *